United States Patent [19]

Proud et al.

[11] 4,427,921

[45] Jan. 24, 1984

[54] ELECTRODELESS ULTRAVIOLET LIGHT SOURCE

[75] Inventors: Joseph M. Proud, Wellesley Hills; Stephen G. Johnson, Georgetown, both of Mass.

[73] Assignees: GTE Laboratories Inc., Waltham, Mass.; GTE Products Corp., Stamford, Conn.

[21] Appl. No.: 307,419

[22] Filed: Oct. 1, 1981

[51] Int. Cl.[3] ..... H05B 41/16; H05B 41/24

[52] U.S. Cl. ..... 315/248; 313/637; 313/638; 315/39

[58] Field of Search ..... 315/248, 39; 313/227, 313/229, 637, 638, 639

[56] References Cited

U.S. PATENT DOCUMENTS

| | | | |
|---|---|---|---|
| 3,234,421 | 2/1966 | Reiling | 313/25 |
| 3,319,119 | 5/1967 | Rendina | 315/248 |
| 4,001,632 | 1/1977 | Haugsjaa et al. | 315/248 |
| 4,185,228 | 1/1980 | Regan | 315/248 |

*Primary Examiner*—Saxfield Chatmon, Jr.
*Attorney, Agent, or Firm*—David M. Keay

[57] ABSTRACT

A source of ultraviolet radiation including an electrodeless lamp containing a metal iodide or iodine. When the contents of the electrodeless lamp are excited by high frequency power, excited iodine atoms emit ultraviolet radiation.

18 Claims, 3 Drawing Figures

ELECTRODELESS ULTRAVIOLET LIGHT SOURCE

BACKGROUND OF THE INVENTION

This invention relates to electromagnetic discharge apparatus. More particularly, it is concerned with electrodeless ultraviolet light sources.

Electrodeless light sources which operate by coupling high frequency power to an arc discharge in an electrodeless lamp have been developed. These light sources typically include a high frequency power source connected to a termination fixture with an inner conductor and an outer conductor disposed around the inner conductor. The electrodeless lamp is positioned adjacent to the end of the inner conductor. High frequency power is coupled to a light emitting electromagnetic discharge within the electodeless lamp. A portion of the termination fixture passes radiation at the frequencies of the light produced, thus permitting the use of the apparatus as a light source.

SUMMARY OF THE INVENTION

It is an object of the present invention to provide an improved electromagnetic discharge apparatus.

It is another object of the invention to provide an electrodeless lamp which serves as a source of ultraviolet light.

An improved source of ultraviolet light is provided by electromagnetic discharge apparatus in accordance with the present invention. The apparatus comprises an electordeless lamp having an envelope of a substance transparent to ultraviolet radiation. The fill material within the envelope comprises a material selected from the group consisting of a metal iodide and iodine. Means are provided for coupling high frequency power to the fill material within the envelope. When high frequency power is applied, the fill material within the envelope is vaporized and excited producing ultraviolet radiation.

The metal iodide or the iodine provides a source of iodine atoms which are excited to a high energy state when high frequency is applied. The excited iodine atoms emit ultraviolet radiation upon photon emission transition to a lower energy state. The ultraviolet light produced during the photon emission transition is at 206.2 nanometers (nm). Metal iodides which have been found particularly useful as a fill material are cadmium iodide and mercuric iodide. In addition to a metal iodide, the fill material desirably may include an inert buffer gas, for example, argon, xenon, neon, or nitrogen. The preferred frequencies for exciting the fill material are those radio frequencies allocated for industrial, scientific, or medical usage located at 13.56, 27.13, 40.68, 915, or 2450 MHz. However, useful frequencies lie within the range of from 1 MHz to 10 GHz.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 2:
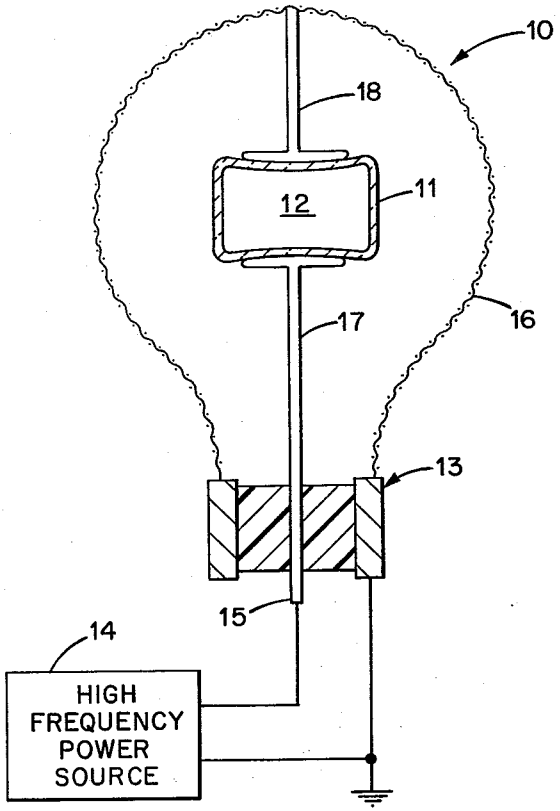
FIG. 2 is a schematic representation of an electrodeless radio frequency coupled discharge light source in accordance with one embodiment of the present invention.

One embodiment of an electromagnetic discharge apparatus in accordance with the present invention is illustrated in FIG. 2. The apparatus 10 includes an electrodeless lamp 11 containing a fill material 12. The electrodeless lamp 11 is supported within a coupling fixture 13 which couples power from a high frequency power source 14 to the fill material of the electodeless lamp. The electrodeless lamp forms a termination load for the fixture.

The electrodeless lamp 11 has a sealed envelope made of a suitable material which is transparent to ultraviolet radiation, for example, fused silica or aluminum oxide. The fill material 12 within the lamp envelope 11 in accordance with the present invention includes a metal iodide or iodine. The vapor pressure of the metal iodide or iodine is preferably less than 1 torr. The metal iodide preferably may be either cadmium iodide or mercuric iodide. A buffer gas such as argon, xenon, neon, or nitrogen at a pressure of from 1 to 50 torr, preferably about 2 torr, is added to the metal iodide fill.

The coupling fixture 13 includes an inner conductor 15 and an outer conductor 16 disposed around the inner conductor. The outer conductor 16 includes a conductive mesh which acts as a conductor and provides shielding at the operating frequencies while permitting the passage of light radiated from the lamp 11. The lamp 11 is supported between a first metal electrode 17 at one end of the inner conductor 15 and a second metal electrode 18 connected to the outer conductor 16. The other ends of the inner and outer conductors are arranged in a coaxial configuration for coupling to the power source 14. In order to achieve electrodeless discharge it is necessary to employ RF power capable of penetrating the lamp envelope while being absorbed strongly in the low pressure discharge plasma contained therein. The power source 14 preferably is a source of continuous wave RF excitation in the range of from 902 to 928 MHz. Structural details of electromagnetic discharge apparatus as illustrated schematically and as described herein are disclosed and claimed in application Ser. No. 307,418 filed concurrently herewith by Joseph M. Proud, Robert K. Smith, and Charles N. Fallier entitled "Electromagnetic Discharge Apparatus."

When high frequency power is applied to an electrodeless lamp 11 containing a metal iodide or iodine, a discharge is initiated in the buffer gas or iodine vapor which warms the contents of the lamp causing an increase in vapor pressure in the fill material. The fill material is thus vaporized and excited. Optical emission is dominantly from excited iodine atoms which emit ultraviolet light at 206.2 nm. Of course, additional emissions will be produced in the visible and ultraviolet portions of the spectrum from radiative transitions in I, $I_2$, $HgI_2$, HgI, Cd, $CdI_2$, CdI, etc., depending on the composition of the fill material. The electrodeless lamp envelope 11 and conductors 17 and 18 are designed for a given power input to maintain an optimum pressure of metal iodide or iodine within the range of $10^{-3}$ to 100 torr for continuous operation. More than 10% of the applied RF power can be converted to ultraviolet light.

Figure 1:
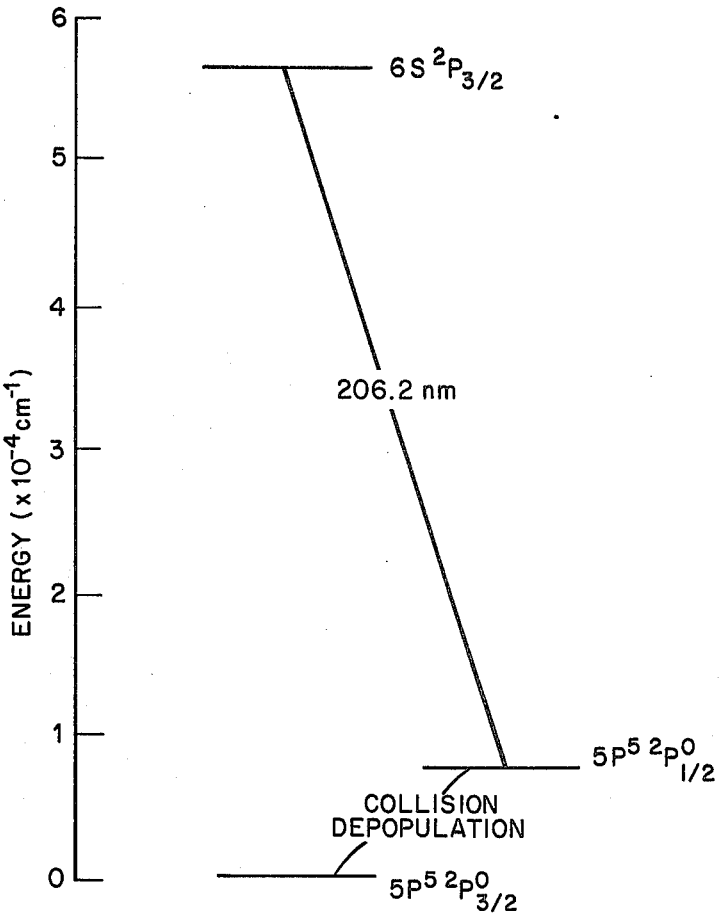
FIG. 1 is an energy level diagram for the iodine atom which illustrates the atomic energy states relevant to understanding the principles of the present invention.

The energy levels involved in the emission of radiation at 206.2 nm from an iodine atom are illustrated in the energy level diagram of FIG. 1. The iodine atom is excited to the $6s^2P_{3/2}$ state which lies about 56000 $cm^{-1}$ above the ground state, which is $5_p{}^5\,{}^2P_{3/2}$. Radiation at 206.2 nm results from a photon emission transition of the excited iodine atom in the $6s^2P_{3/2}$ state to a low lying intermediate metastable state, $5_p{}^5\,{}^2P^\circ_{\frac{1}{2}}$, which lies 7600 $cm^{-1}$ above the ground state. The degree of absorption of atomic radiation per unit path length is proportional to the number density of atoms in the lowest atomic energy level involved in the transition which will be encountered in a unit path length. Thus, the absorption of 206.2 nm radiation will be dependent upon the number of iodine atoms in the metastable $5_p{}^5\,{}^2P^\circ_{\frac{1}{2}}$ state. Reabsorption of the radiation may result in an energy wasteful radiationless process. If the metastable $5_p{}^5\,{}^2P^\circ_{\frac{1}{2}}$ state is quenched or depopulated by collision processes, then absorption of radiation can be minimized, enhancing the efficiency of the light source. The presence of the buffer gas greatly facilitates the collision depopulation or quenching process.

Figure 3:
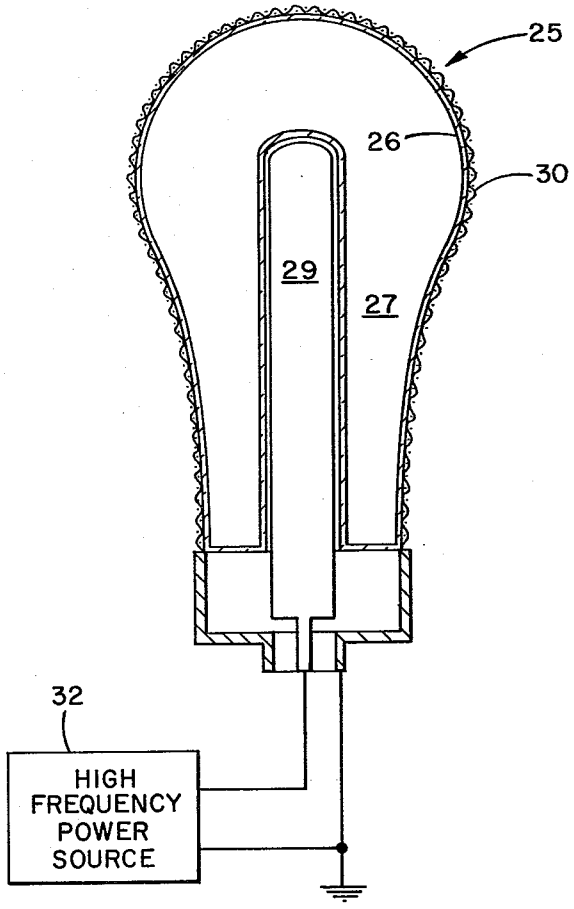
FIG. 3 is a representation of an alternative form of and electrodeless discharge device in accordance with the present invention.

FIG. 3 is a schematic representation of an alternative embodiment of an electromagnetic discharge apparatus 25 in accordance with the present invention. The apparatus 25 includes an electrodeless lamp 26 having an envelope in the shape of a reentrant cylinder providing a generally annular discharge region 27. The fill material of the lamp includes a metal iodide or iodine as described hereinabove with respect to the embodiment of FIG. 2. The RF coupling arrangement includes a center electrode 29 disposed within the internal reentrant cavity in the envelope 26. An outer conductive mesh 30 surrounds the envelope 26 providing an outer electrode which is transparent to radiation from the lamp. The center electrode 29 and outer mesh 30 are coupled by a suitable coaxial arrangement 31 to a high frequency power source 32. A radio frequency electric field is produced between the center electrode 29 and the outer mesh 30 causing ionization and breakdown of the fill material. Ultraviolet radiation at 206.2 nm is produced by the resulting glow discharge within the lamp as explained previously. Specific details of the structure of apparatus of this general type are shown in U.S. Pat. No. 4,266,167 which issued May 5, 1981, to Joseph M. Proud and Donald H. Baird, entitled "Compact Fluorescent Light Source and Method of Excitation Thereof."

Thus, there is provided an electromagnetic discharge apparatus employing an electrodeless lamp as a source of ultraviolet radiation. The electrodeless lamp includes no metallic elements within the envelope. Thus the metal iodides which are chemically very active are not in contact with any material with which they might react. The use of a metal iodide as the source of iodine atoms within the discharge envelope has the advantage of providing an easy starting discharge. The iodine vapor is effectively scavenged by the metal iodide molecules so that there are few atoms or molecules in the vapors of an extinguished device which will attach electrons generated in the starting procedure. The discharge once started warms the lamp sufficiently to vaporize enough of the metal iodide to supply an iodine rich emission spectrum in the ultraviolet.

While there has been shown and described what are considered preferred embodiments of the present invention, it will be obvious to those skilled in the art that various changes and modifications may be made therein without departing from the invention as defined by the appended claims.

What is claimed is:

1. An electromagnetic discharge apparatus comprising an electrodeless lamp having an envelope of a substance transparent to ultraviolet radiation;

a fill material within said envelope consisting essentially of a metal iodide and an inert buffer gas; and means for coupling high frequency power to the fill material within the envelope whereby when high frequency power is applied, the fill material within the envelope is vaporized and excited producing ultraviolet radiation.

2. An electromagnetic discharge apparatus in accordance with claim 1 wherein said fill material consists essentially of a metal iodide selected from the group consisting of cadmium iodide and mercuric iodide, and an inert buffer gas.

3. An electromagnetic discharge apparatus comprising an electrodeless lamp having an envelope of a substance transparent to ultraviolet radiation;

a fill material within said envelope consisting essentially of iodine; and means for coupling high frequency power to the fill material within the envelope whereby when high frequency power is applied, the fill material within the envelope is vaporized and excited producing ultraviolet radiation.

4. An electromagnetic discharge apparatus in accordance with claim 1 wherein said fill material consists essentially of cadmium iodide and an inert buffer gas.

5. An electromagnetic discharge apparatus in accordance with claim 1 wherein said fill material consists essentially of mercuric iodide and an inert buffer gas.

6. An electromagnetic discharge apparatus in accordance with claim 1 wherein said means for coupling high frequency power to the fill material includes an inner conductor and an outer conductor disposed around the inner conductor, the conductors having means at one end adapted for coupling to a high frequency power source and means at the other end for coupling high frequency power to the electrodeless lamp.

7. An electromagnetic discharge apparatus in accordance with claim 6 wherein said fill material consists essentially of a metal iodide selected from the group consisting of cadmium iodide and mercuric iodide, and an inert buffer gas.

8. An electromagnetic discharge apparatus in accordance with claim 7 wherein said fill material includes an inert buffer gas at a pressure of 1–50 torr.

9. An electromagnetic discharge apparatus in accordance with claim 8 wherein said fill material includes an inert buffer gas at a pressure of about 2 torr.

10. An electromagnetic discharge apparatus in accordance with claim 7 further including a source of high frequency power at a frequency between 1 MHz and 10 GHz coupled to said means at said one end of the conductors.

11. An electromagnetic discharge apparatus comprising an electrodeless lamp having an envelope of a substance transparent to ultraviolet radiation enclosing a fill material; and means for coupling high frequency power to the fill material within the envelope;

the fill material being selected from the group consisting of a source of iodine atoms which are excited to a high energy state when high frequency power is applied and which emit ultrviolet radiation by photon emission transition to a lower energy state together with an inert buffer gas, and a source of iodine atoms which are excited to a high energy state when high frequency power is applied and which emit ultraviolet radiation by photon emission transition to a lower energy state.

12. An electromagnetic discharge apparatus in accordance with claim 11 wherein the iodine atoms are excited to the $6s^2P_{3/2}$ state when high frequency power is applied, and emit ultraviolet radiation at 206.2 nanometers upon photon emission transition to the $5p^{52}P^{\circ}_{\frac{1}{2}}$ metastable state.

13. An electromagnetic discharge apparatus in accordance with claim 12 wherein said fill material consists essentially of a metal iodide selected from the group consisting of cadmium iodide and mercuric iodide, and an inert buffer gas.

14. An electromagnetic discharge apparatus in accordance with claim 12 wherein said fill material consists essentially of iodine.

15. An electromagnetic discharge apparatus in accordance with claim 12 wherein said means for coupling high frequency power to the fill material includes an inner conductor and an outer conductor disposed around the inner conductor, the conductors having means at one end adapted for coupling to a high frequency power source and means at the other end for coupling high frequency power to the electrodeless lamp.

16. An electromagnetic discharge apparatus in accordance with claim 15 further including a source of high frequency power at a frequency between 1 MHz and 10 GHz coupled to said means at said one end of the conductors.

17. An electromagnetic discharge apparatus in accordance with claim 3 wherein said means for coupling high frequency power to the fill material includes an inner conductor and an outer conductor disposed around the inner conductor, the conductors having means at one end adapted for coupling to a high frequency power source and means at the other end for coupling high frequency power to the electrodeless lamp.

18. An electromagnetic discharge apparatus in accordance with claim 17 further including a source of high frequency power at a frequency between 1 MHz and 10 GHz coupled to said means at one end of the conductors.

* * * * *